US007422389B2

(12) United States Patent
Abergel

(10) Patent No.: US 7,422,389 B2
(45) Date of Patent: Sep. 9, 2008

(54) DEVICE FOR PACKAGING AND APPLICATION OF A PRODUCT, IN PARTICULAR AN EYELINER

(75) Inventor: Aline Abergel, Boulogne (FR)

(73) Assignee: L'Oreal, Paris (FR)

( * ) Notice: Subject to any disclaimer, the term of this patent is extended or adjusted under 35 U.S.C. 154(b) by 476 days.

(21) Appl. No.: 10/650,753

(22) Filed: Aug. 29, 2003

(65) Prior Publication Data

US 2004/0129284 A1 Jul. 8, 2004

Related U.S. Application Data

(60) Provisional application No. 60/409,947, filed on Sep. 12, 2002.

(30) Foreign Application Priority Data

Aug. 30, 2002 (FR) ..... 02 10796

(51) Int. Cl.
*B65B 17/00* (2006.01)

(52) U.S. Cl. ..... 401/208; 401/218; 401/220; 401/213

(58) Field of Classification Search ..... 401/208, 401/218, 220, 213
See application file for complete search history.

(56) References Cited

U.S. PATENT DOCUMENTS

| | | | | | |
|---|---|---|---|---|---|
| 637,832 | A | * | 11/1899 | Rosenberg | 401/208 |
| 768,504 | A | * | 8/1904 | Bagby | 401/208 |
| 1,225,067 | A | | 5/1917 | Simpson | |
| 1,297,217 | A | * | 3/1919 | Mendell | 401/208 |
| 2,151,682 | A | * | 3/1939 | Burkey | 401/208 |
| 2,163,355 | A | | 6/1939 | Sechrist | |
| 2,229,707 | A | | 1/1941 | Testi | |
| 2,572,034 | A | * | 10/1951 | Johnson | 401/208 |
| 3,003,468 | A | * | 10/1961 | Rosenthal | 401/208 |
| 3,076,995 | A | * | 2/1963 | Rabelow | 401/208 |
| 3,465,673 | A | * | 9/1969 | Oppenheim | 401/208 |
| 4,723,860 | A | * | 2/1988 | Giblin et al. | 401/208 |
| 4,840,511 | A | | 6/1989 | Fattori et al. | |
| 5,395,175 | A | * | 3/1995 | Bontoux et al. | 401/220 |
| 5,401,113 | A | | 3/1995 | Gueret | |
| 5,435,245 | A | * | 7/1995 | Salisbury et al. | 401/208 |
| 6,729,788 | B2 | * | 5/2004 | Bouveresse | 401/208 |

FOREIGN PATENT DOCUMENTS

| | | |
|---|---|---|
| FR | 2412287 | 7/1979 |
| FR | 2633256 | 12/1989 |
| WO | WO 02/28546 | 4/2002 |

* cited by examiner

*Primary Examiner*—Khoa D Huynh
(74) *Attorney, Agent, or Firm*—Oblon, Spivak, McClelland, Maier & Neustadt, P.C.

(57) ABSTRACT

A device for packaging and applying a product, which includes a container suitable for containing the product, and an application component having at least one applicator portion suitable for coming in contact with the product in order to take up some of the product. A rotational coupling arrangement is provided on at least one side of the applicator portion to allow the application component to be moved in rotation about an axis Y relative to the container. The application component includes at least one portion separating the applicator portion from the coupling means, with portion(s) having a non-constant cross section measured transversely to the axis of rotation Y.

43 Claims, 5 Drawing Sheets

Fig. 3
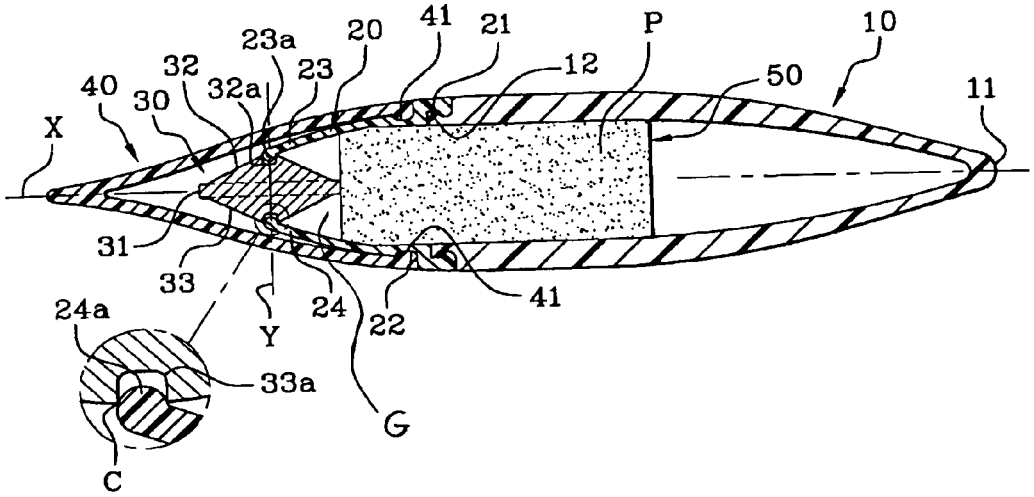
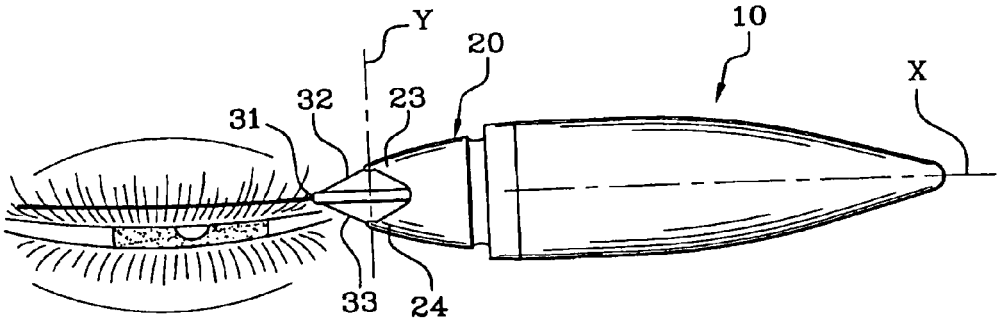
Fig. 4

Fig. 7
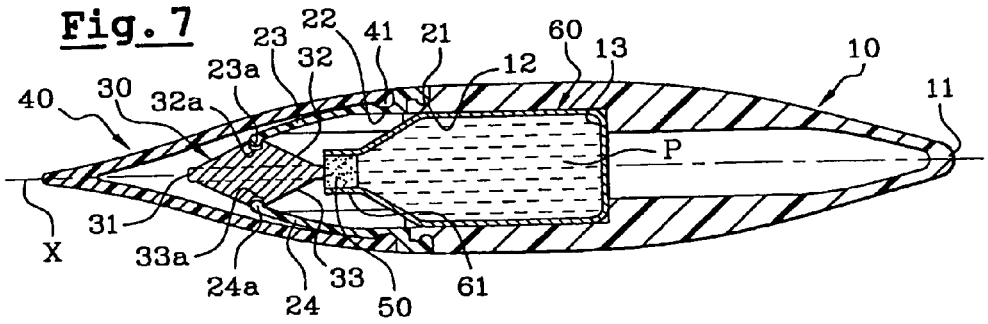
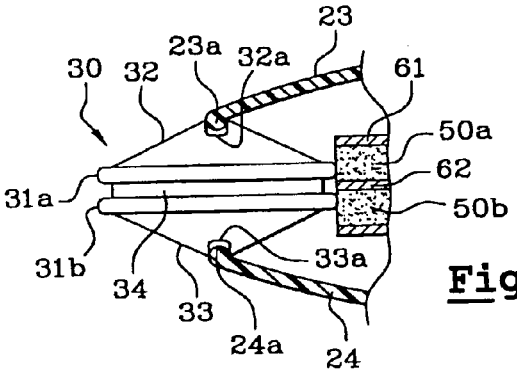
Fig. 8
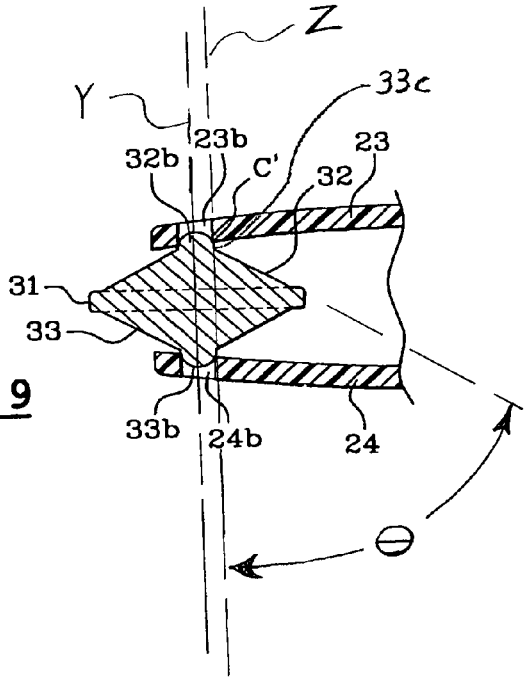
Fig. 9

Fig. 10A
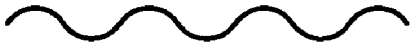
Fig. 10B
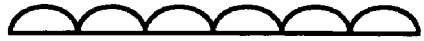
Fig. 10C
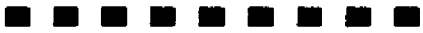
Fig. 10D
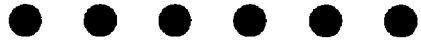
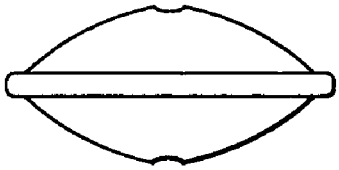
Fig. 11A
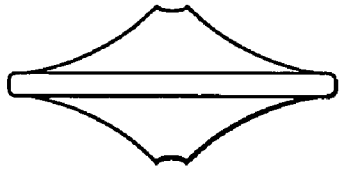
Fig. 11B
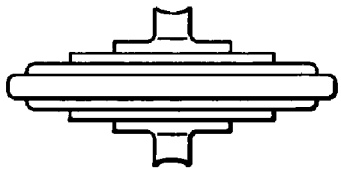
Fig. 11C

DEVICE FOR PACKAGING AND APPLICATION OF A PRODUCT, IN PARTICULAR AN EYELINER

CROSS-REFERENCE TO RELATED APPLICATIONS

This document claims priority to French Application No. 02 10796, filed Aug. 30, 2002 and U.S. Provisional Application No. 60/409,947, filed Sep. 12, 2002, the entire content of which is hereby incorporated by reference.

BACKGROUND OF THE INVENTION

1. Field of the Invention

The present invention relates to a device for packaging and applying of a product, especially a fluid product, for example, a liquid or pasty product. The invention is particularly advantageous for the application of a cosmetic product to the skin.

2. Discussion of Background

The term cosmetic product is intended to mean a product as defined in Council Directive 93/35/EEC of 14 Jun. 1993, amending for the sixth time Directive 76/768/EEC. The invention can advantageously provide a device for application of a cosmetic product. The invention is particularly advantageous for use in applying a make-up product to the eyelids, and more particularly, for application of a line to the eyelids, namely with an eyeliner.

In order to draw a line on the eyelids, it is known to use make-up pencils. It is also known to use devices which include a reservoir containing a liquid product and an applicator equipped with a flexible application element for application of the product. Such devices are, for example, described in the patent applications FR-A-2 633 256 and FR-A-2 412 287. In this type of device, a tip which is flocked or made of felt so as to hold some of the product, or alternatively a tip which includes capillary grooves to hold some of the product, forms the application element. The application element may also be in the form of a brush. When the device is in the closed position, the applicators are immersed in the reservoir in order to take up some of the product. In order to draw a line on her eyelid, the user opens the device by removing the applicator, the tip of which has some of the product on it. The user then draws a line in the same way as with a pencil, that is to say by applying the application element on one side of the eyelid and moving it as far as the other end.

With such application elements, however, it is very difficult to draw a line which is uniform, with a constant thickness over the entire length of the line. This is because the user tends to press on the tip with variable strength when she is drawing the line, such that the tip spreads out variably on the eyelid and varies the width of the tip applied to the eyelid and the line being drawn. In the case of a brush, it is also very difficult to obtain a thin line which is uniform.

Furthermore, it is very difficult to draw an identical line on both eyelids, because the user does not use the same hand movements for drawing a line on the two eyelids. The user either changes hands for each eyelid (entailing the use of one hand with which she is less accustomed) or uses the same hand for both eyelids (entailing different movements in drawing lines of the different eyelids with the same hand). Here again, in performing a different hand movement for each eyelid, the user will tend not to press on the tip of the brush in the same way for both eyelids.

Furthermore, since the eyelid is a very flexible surface, it tends to crease when the tip of the applicator is being moved with sufficient pressure to deposit the product. As a result, it is very difficult to make a continuous line over a creased surface.

Also known are devices for drawing lines on paper which consist of a roller that comes in contact with an ink pad in order to take up some of the ink before transferring the ink onto the paper. A device of this type is, for example, described in U.S. Pat. No. 1,225,067. The roller consists of a flat disc which is fitted so as to rotate on a hoop, which itself is fitted on a container containing the ink pad. Such a device, however, is not suitable for drawing a line on the eyelid. This is because the roller is fitted so as to rotate by means of an attached axle which is fixed at its ends to two side walls of the hoop, which are parallel to the plane of the roller. The roller is arranged relatively close to the side walls, so that they limit the tilting of the roller and/or its translation along the axis of rotation, with these movements possible by the play existing between the roller and the attached axle which is necessary for rotation of the roller. With this arrangement, when the user is drawing a line, the roller rubs against at least one wall so that it does not roll well. It is then necessary to exert a relatively strong pressure on the paper in order to make the roller roll and draw a line. Accordingly such a device would not be acceptable for drawing a thin and uniform line on an eyelid, which could not withstand such pressure.

U.S. Pat. No. 2,163,355 discloses a device for applying a solid lipstick. The device includes a wheel fitted so as to rotate by means of an attached axle. U.S. Pat. No. 2,229,707 discloses a device for dispensing shaving cream, with the device fitted on a tube head. The device includes a rotatably mounted roll which defines a cylindrical application surface. Such devices would not be suitable for drawing uniform lines, particularly on an eyelid, and do not overcome problems associated with conventional line drawing devices as discussed earlier.

SUMMARY OF THE INVENTION

It is therefore one of the objects of the invention to produce an application device which does not have the drawbacks of the prior art.

It is an object of the invention to provide a device for application of a make-up product which makes it possible to draw a relatively thin line that is uniform over its full length.

It is another object of the invention to provide a device which makes it possible to draw a line quickly with a high degree of precision.

It is a further object of the invention to provide a device which makes it readily possible to draw patterns with varied shapes.

According to the invention, these and other objects and advantages can be achieved by a device for packaging and applying a product. The device includes a container suitable for containing the product. An application component is also provided having at least one applicator portion suitable for coming in contact with the product in order to take up or hold some of the product. In addition, a product holding component in the form of a porous or fibrous component is contained at least partly inside the container, and is suitable for absorbing or holding some of the product and releasing it to the applicator portion(s). Further, rotational coupling means are arranged on at least one side of the applicator portion to allow the application component to be moved in rotation about an axis Y relative to the container. The application component includes a portion separating the applicator portion from the coupling means, with this portion having a non-constant cross section along the axis Y, measured transversely to the axis of rotation Y.

Since the application component can rotate, the pattern, for example the line, is produced while the applicator portion is being moved over the eyelid while exerting very little friction on it, in contrast to a make-up pencil or a tip traditionally used for application of an eyeliner.

Further, since the application component includes a portion with a non-constant cross section separating the coupling means from the applicator portion, an application component is obtained which includes an applicator portion that is relatively thin but laterally stiffened. This further makes it possible to position the applicator portion away from the coupling means.

With the arrangement of the invention, the play associated with the coupling means entails a less significant deviation of the application component, at the level of the applicator portion, when the coupling means are situated at a distance from the plane in which the applicator portion moves as compared with the arrangement of U.S. Pat. No. 1,225,067 in which when they are formed substantially in this plane. The reason is that, with the '067 arrangement, since the roller has a constant thickness and is very thin so as to define an applicator portion which makes it possible to draw a thin line at the periphery, the coupling means are formed substantially in the same plane as the plane in which the applicator portion moves. Hence, the play existing level with the coupling means entails a relatively significant deviation of the applicator portion whereas, in contrast, the applicator portion of the device of the invention tends to remain in a plane substantially perpendicular to the axis of rotation without deviating from this plane. It is hence possible to obtain a line which is relatively straight over its full length.

Furthermore, the use of a porous or fibrous component makes it possible to limit the risk of product leaks when a liquid product is being used, for example.

According to another optional feature of the invention, the device may include coupling means on each side of the applicator portion.

According to a further optional advantageous feature, the cross section of the portion separating the applicator portion from the coupling means decreases progressively along the axis Y, from the applicator portion as far as the coupling means. This limits the surface area of the application component liable to come in contact, during the rotation, with the container or with an intermediate element secured to the container which carries the application component, so as to limit the friction by stiffening the application component.

Advantageously, the coupling means includes of the interaction of at least one lug with at least one cavity which are formed respectively on the application component and on the container or on an element secured to the container, or vice versa. It is hence possible to obviate the need for an attached rotation axle, so that the number of constituent elements of the device is limited, and therefore, so is the play between the various pieces. It is hence possible to obtain a more precise device making it possible to draw a more precise line. Further, the shape of the lugs and the cavities may be selected so that the lug only comes in contact with the edge delimiting the cavity along a circular generatrix, with the generatrix being continuous or discontinuous. A uniquely linear contact is therefore obtained, which further limits the friction during rotation of the application component.

Advantageously, the application component can be removably fitted on the container. The user will hence be able to change the application component if she wishes, and replace it with another application component which, for example, includes a different applicator portion to draw a pattern with a different shape.

The application component is, for example, fixed on the container via a mounting hoop which may be fixed to the container by, for example, snap fastening or screwing. The applicator portion may be formed by an annular surface of constant or variable width, which may be continuous. The applicator portion may, alternatively, be discontinuous.

According to a particular embodiment of the invention, the application component may optionally include at least two applicator portions which make it possible to draw at least two different patterns. The two applicator portions can be used simultaneously or separately according to the user's choice. The two applicator portions may be identical or, alternatively, different.

When the application component includes at least two applicator portions, the device may also include at least two porous or fibrous components, each suitable for containing a different product and releasing it to each of the applicator portions, so that each applicator portion is coated with a different product, for example, products having different colors.

The porous or fibrous component can include a material selected from cellular materials, for example, foams or frits, or textile fibers.

According to one embodiment of the invention, all of the product can be contained in the porous or fibrous component. Alternatively, provision may be made for the product to be partially contained inside the container and for it to be absorbed progressively by the porous or fibrous component as the applicator portion takes up the product.

Also alternatively, the device may also include a bottle provided with an open neck accommodated in the container and containing the product, with the porous or fibrous component being accommodated inside the neck of the bottle or fixed above the neck of the bottle.

The device can also include a closure cap intended to cover the application component.

The objects of the invention can also be achieved by achieved by providing a device for packaging and applying a product, which includes a container suitable for containing the product, and an application component with at least one applicator portion suitable for coming in contact with the product in order to take up some of the product. In addition, a rotational coupling means is arranged on at least one side of the applicator portion, to allow the application component to be moved in rotation about an axis Y relative to the container. In accordance with an example of the coupling means, at least one lug interacts with at least one cavity, with the lug and cavity respectively formed on the application component and on the container or on an element secured to the container, or vice versa. With this example, the lug is in contact with the edge delimiting the cavity according to essentially a continuous or a discontinuous line. Further, the application component can include a portion separating the applicator portion from the coupling means, with this portion having a non-constant cross section measured transversely to the axis of rotation Y.

According to another aspect of the invention, a method for making up the skin, particularly the eyelid, is provided. The method can be performed using a device as described above. In accordance with the method, the applicator portion(s) of the application component is applied to the skin. The device is moved in translation so as to turn or rotate the application component about the axis Y in order to draw a pattern on the skin.

BRIEF DESCRIPTION OF THE DRAWINGS

Other characteristics and advantages of the invention will become apparent from the following detailed description, particularly when considered in conjunction with the drawings in which:

FIG. 3 represents the device illustrated in FIG. 1 in axial cross-section (along the length of the device), with the cap closed;

FIG. 4 illustrates the device illustrated in FIG. 1 during use;

FIG. 7 represents a fourth embodiment of a device for packaging and application of a product according to the invention in axial cross-section;

FIG. 8 represents a fifth embodiment of a device for packaging and application of a product according to the invention in axial cross-section;

FIG. 9 represents a variant of the application component of the device for packaging and application of a product according to the invention in partial axial cross-section;

FIGS. 10A to 10D represent variants of the applicator portion of the device of the invention in plan view along a portion of the circumferential length of the applicator portion (with the length extending from left to right in the drawings); and FIGS. 11A to 11C represent variants of the application component.

DETAILED DESCRIPTION OF THE PREFERRED EMBODIMENTS

Figure 1:
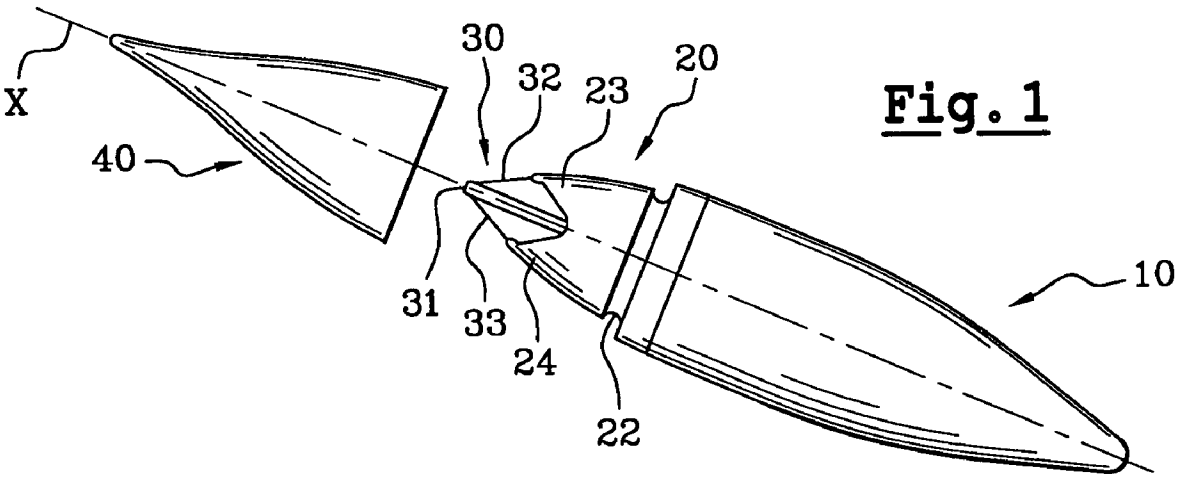
FIG. 1 illustrates a perspective view of a first embodiment of a device for packaging and applying a product according to the invention.
Figure 2:
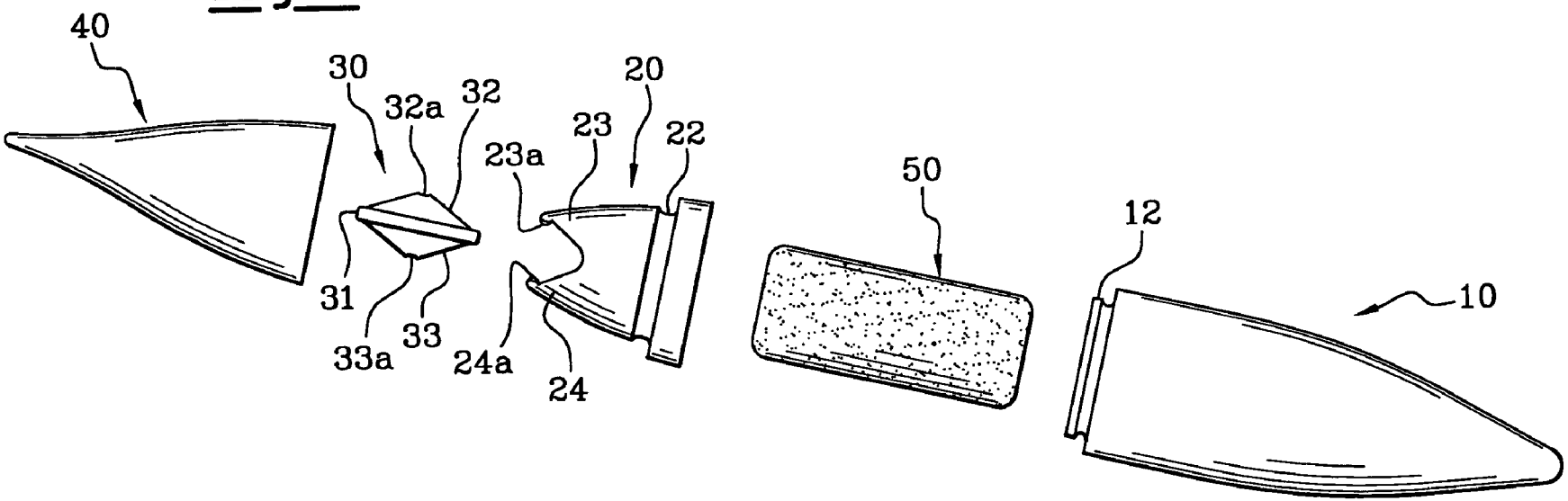
FIG. 2 represents an exploded view of the device illustrated in FIG. 1.

FIGS. 1 to 4 represent an example of a packaging and application device including a container 10 secured, via a hoop 20, to an application component 30 which is covered by a cap 40 in the closed position. The container contains a cosmetic product P, preferably a liquid cosmetic product, and in particular a make-up product, for example a liquid ink, intended to be applied to an eyelid. It is also possible to use a relatively viscous or pasty product, which could be contained directly in the container.

The container 10 has a longitudinal axis X and a circular cross section which decreases progressively as far as a first end forming a bottom 11 (FIG. 3). The second end of the container is open and terminates in a free edge having a click bead 12 for fastening the hoop 20 on the container. FIG. 3 further shows a gap G disposed on either side of an annular application surface 31.

The hoop 20 includes a base of circular cross section provided with an annular groove 21 on its inner wall, which allows it to be fastened axially on the container. The groove 21 accommodates the click bead 12 of the container 10. At its base, the hoop 20 also has a second annular groove 22 on its outer wall, intended to accommodate an annular thread 41 formed on the cap in order to close the device. Two diametrically opposite concave tabs 23 and 24 extend from the base of the hoop while decreasing progressively (decreasing in cross-section) as far as two ends 23*a* and 24*a*, formed by two lugs which are oriented toward one another and toward the inside of the hoop. These two lugs 23*a* and 24*a* have a hemispherical shape and are used to hold the application component 30 on the hoop. Furthermore, the lugs 23*a* and 24*a* define an axis of rotation Y perpendicular to the longitudinal axis X of the container, allowing the application component 30 to rotate.

According to the example which is represented, the application component 30 is a solid component. It is formed by a disc which defines the annular application surface 31 at the periphery. The disc has a constant thickness over its entire periphery, so as to define an application surface which is continuous and of constant width over its entire periphery. Different application surfaces may be used, for example, those represented in a developed form in FIGS. 10A to 10D, in order to draw a different pattern on the eyelid. FIGS. 10A-D are plan views of portions of the circumference of the applicator portion looking down onto the surface, with the length of the circumference extending left to right in the figures. (The entire circumferential surface can be envisioned by extending the portions shown and curving the portions about an axis extending vertically with respect to the page of the drawing figures. In other words, the surfaces as shown in FIGS. 10A-D could be placed or superimposed on the substantially flat applicator portions of FIGS. 11A-C for a view of the entire applicator having the modified surfaces for the applicator portion.) By way of example, it is possible to use an application component whose application surface has corrugated shape (FIG. 10A) or alternatively defines a continuous line surmounted by a succession of circle arcs (FIG. 10B). The application surface may also be discontinuous (FIGS. 10C and 10D) so as to form a dashed line.

At a distance from the application surface 31, each face of the disc is formed by two conical portions 32 and 33, which each include a cavity 32*a* and 33*a* at the apex of the cone. Each of the cavities 32*a* and 33*a* is intended to accommodate a lug 23*a* and 24*a* so as to form rotational coupling means on each side of the applicator portion, allowing the application component to rotate about the axis of rotation Y. The cavities 32*a* and 33*a* have, in this example, a cylindrical shape, with their cross section measured transverse to the axis of rotation Y being circular. Each hemispherical lug 23*a* and 24*a* is hence only in contact with the application component on a circular generatrix C, so as to limit the friction between the application component and the hoop when the product is being applied. This therefore makes it easy for the application component to be moved in rotation, without the user having to exert too great a pressure on the eyelid in order to prevent the application component from sliding over the eyelid instead of rolling.

It is to be understood that the arrangement of FIGS. 1 to 4 is provided as an example, as variations are possible for the various shapes and couplings/connections in the assembly. Although not to be considered as exhaustive, the following are examples of alternatives. According to an alternative which has not been illustrated, the lugs 23*a* and 24*a* and/or the edges delimiting the cavities 32*a* and 33*a* can be provided with recesses such that the contact area between the lugs and the edges delimiting the cavities be discontinuous. Further, although the lugs are provided on the hoop and the cavities are provided on the application component, their positions could be reversed as noted earlier herein. In addition, in the example which is represented, the conical portions 32 and 33 separate the applicator portion from the rotational coupling means, but it is clear that any other form or shape could be used in order to position the coupling means away from the plane in which the application surface moves. For example, the conical portion could be slightly convex (FIG. 11A), or conversely slightly concave (FIG. 11B), or alternatively have a staggered or stepped shape (FIG. 11C).

A porous component 50 is accommodated partly inside the container 10 and partly inside the hoop 20. By way of example, in this embodiment the component 50 can be a block of open-celled foam which contains the liquid product P. Since the product P is absorbed in the foam, it cannot flow out of the container. Alternatively, the component 50 may include a felt or any other fibrous material suitable for absorbing some of the product. The block of foam is slightly compressed laterally by the side wall of the container and by the wall of the hoop, so that it is held fixed inside the container. The block of foam is positioned axially at a height such that, during its rotation, the application surface of the application component comes in contact with the block opponent so as to take up some of the product.

The closure cap 40 is removably fixed on the hoop by means of the thread 41 provided on the inner surface of its wall, which interacts with the annular groove 23 of the hoop while covering the application component 30.

In order to apply a line to the eyelid, the user removes the cap 40 and, while holding the container which is used as a gripping handle, disposes the application surface on her eyelid. It is then sufficient for the user to move the device in translation along the eyelid in order to make the application surface roll on the eyelid. The product is then transferred onto the eyelid so as to form a line, as can be seen in FIG. 4. The applicator portion becomes replenished with the product as the line is being drawn.

Figure 5:
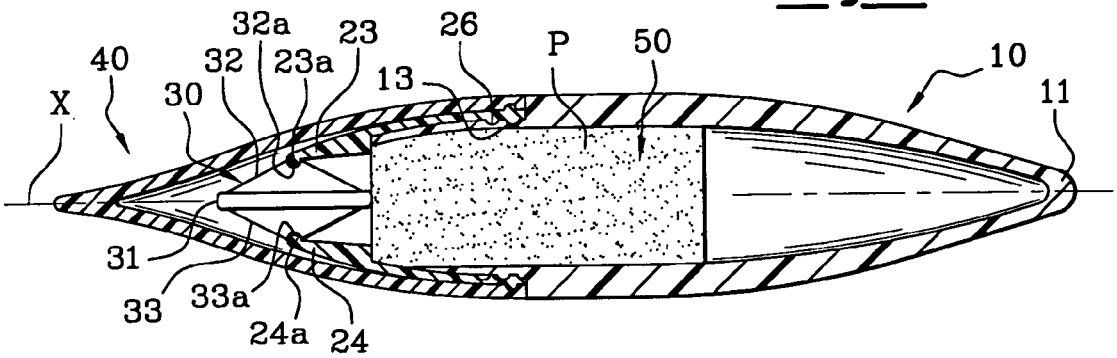
FIG. 5 represents a second embodiment of a device for packaging and application of a product according to the invention in axial cross-section.

It is to be understood that any suitable form can be used for coupling the hoop to the container. For example, the device illustrated in FIG. 5 differs from the one which has just been described in so far as the hoop is fixed on the container not by snap-fastening but by screwing. With this arrangement, the inner surface of the hoop includes a screw thread 26 at its base, which interacts with a corresponding screw thread 13 formed on the outer surface of the container 10. With this arrangement, the user can easily remove the hoop 20 from the container in order, for example, to add some product in the porous component or alternatively to change the porous component, and she can then easily reattach it. The user can also replace the hoop with another hoop including an application component provided, for example, with an application surface of different shape, such as one of those represented in FIGS. 10A to 10D, in order to draw a different pattern on the eyelid.

Figure 6:
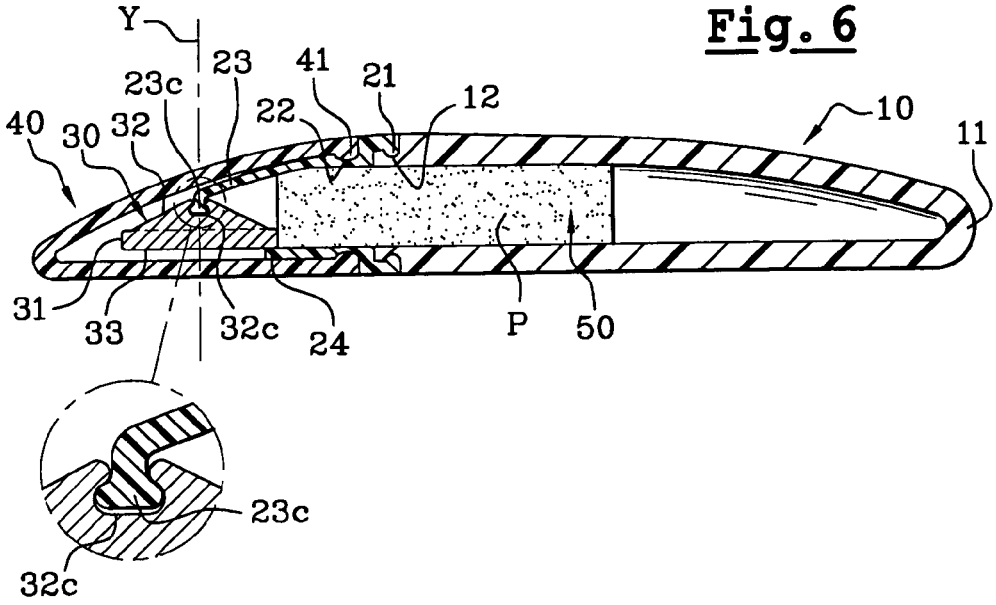
FIG. 6 represents a third embodiment of a device for packaging and application of a product according to the invention in axial cross-section.

The device represented in FIG. 6 differs from the first embodiment illustrated in FIGS. 1 to 4 in so far as the application component includes only one conical portion 32 with the other face of the disc being flat. The application component is also asymmetrical, so the device is asymmetrical overall. In particular, the cross-sections of the hoop 20 and of the container 10, measured transversely to the axis X, are in the shape of an arc or semicircle. Furthermore, the coupling means are formed only on one side of the applicator portion. The coupling means are formed by the interaction of a nail-head-shaped cavity 32*c* with a substantially identically shaped cavity 23*c*, which allows the application component to rotate while preventing it from tilting. With this arrangement, the hoop includes only a single tab 23. With such a device, by disposing the flat face of the disc on the side next to the eyelashes, the user can draw a line relatively close to the eyelashes without being hampered by the eyelashes.

FIG. 7 represents a third embodiment of the device, which differs from the first in so far as it furthermore includes a bottle 60 in which the product P is contained. The bottle is arranged inside the container 10, and its bottom abuts against an axial stop 13 formed in the wall of the container. The bottle 60 includes an open neck 61 in which a block of foam 50 impregnated with product P is accommodated, on which the application surface of the application component comes in contact during its rotation so as to take up some of the product. The block of foam 50 or other product holding component can be disposed inside of the bottle opening and/or outside of (above) the bottle opening. Whether the product holding component is inside of the neck, or is partially or entirely outside of the neck, the product holding component can be positioned sufficiently adjacent to the bottle opening to receive the product and allow the applicator portion to come into contact with the product holding component to take up the product on the applicator surface. Such an embodiment has the advantage that it is easy to replenish the device with product since it is easy to remove the bottle when it is empty and provide another full one. Furthermore, packaging the product in a bottle limits the contact of the product with the air and therefore its evaporation. The risks of the product leaking and the risks of the product being contaminated by elements which may be added to the product by the applicator portion are also limited or reduced. Furthermore, when a bottle is used for packaging the product, the size of the porous component is relatively reduced so that substantially all of the product contained in this component can be taken up by the applicator portion, so that the utilization factor of the product is more optimal.

The device represented partially in FIG. 8 differs from the one represented in FIG. 7 in that it includes an application component provided with two application surfaces 31*a* and 31*b*, which are formed at the periphery of two parallel discs separated by a central portion 34 which connects them. Each outer face of each disc includes a conical portion 32 and 33. According to this embodiment, two porous components 50*a* and 50*b* are provided inside the bottle 60. A partition 62 separates the interior of the bottle into two parts so as to isolate two compartments, each including one of the porous components 50*a* and 50*b*. It will hence be possible to use a different product in each compartment so as to be able to coat each application surface with a different ink, for example, an ink with a different color. It is thus possible to draw two lines of different colors simultaneously, or alternatively, selectively by inclining the device slightly during application on the eyelid.

It is clear that such an application component may also be used with one of the other embodiments described above which only includes a single porous component. The two application surfaces 31*a* and 31*b* will then be coated with the same product.

The application surfaces 31*a* and 31*b* can be the same or different, for example, using the surfaces as described in FIGS. 10A to 10D or a flat surface.

FIG. 9 represents a variant of the application component and of the hoop, which can be used in the embodiments which have been described herein. With this arrangement, the means for rotational coupling of the application component on the hoop are provided by the interaction of hemispherical lugs 32*b* and 33*b*, which are formed on the application component 30 and which replace the cavities, with two openings 23*b* and 24*b* of circular cross section formed in the hoop 20 instead of the hemispheres. Here again, the friction between the application component and the hoop is relatively limited because each hemisphere 32*b* and 33*b* is only is in contact with the hoop 20 on a circular generatrix C'. As shown in FIG. 9, the surface of the conical portion 32 forms an acute angle θ with a line Z parallel to the axis of rotation Y at a section 33*c* immediately adjacent to the lug 32*b* and the cavity 23*b*. As is evident from FIG. 9, the section 33*c* has the smallest diameter of the conical portion 32.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A device for packaging and applying a product, comprising:

a container suitable for containing the product;

an application component including at least one applicator portion suitable for coming in contact with the product in order to take up some of the product;

a product holding component contained at least partly inside the container and which is suitable for holding some of the product and releasing it to the at least one applicator portion, said product holding component including at least one of a porous material and a fibrous material;

a rotational coupling arranged on at least one side of the applicator portion comprising a lug disposed inside a cavity and allowing the application component to be moved in rotation about an axis Y relative to the container, wherein the application component includes at least one portion separating the applicator portion from the rotational coupling, the at least one portion having a non-constant cross section measured transversely to the axis of rotation Y, and wherein a diameter of the at least one portion continuously decreases from the applicator portion to one of the lug and the cavity, and the at least one portion includes a section, which is a section of the at least one portion with a smallest diameter, immediately adjacent to the one of the lug and the cavity, and said section extends from said coupling by defining an acute angle with a line parallel to the axis of rotation, as measured inside the at least one portion, where the section and the one of the lug and cavity meet.

2. A device according to claim 1, wherein a rotational coupling is provided on each side of the applicator portion.

3. A device according to claim 1 wherein the cavity is associated with the application component, and the lug is associated with said container.

4. A device according to claim 3, wherein a mounting hoop is mounted on said container and said lug is provided on said mounting hoop.

5. A device according to claim 1, wherein the lug is associated with the application component and the cavity is associated with said container.

6. A device according to claim 5, wherein a mounting hoop is mounted on said container and said at least one cavity is provided on said mounting hoop.

7. A device according to claim 1, wherein the application component is removably fitted on the container.

8. A device according to claim 1, wherein a mounting hoop is mounted on said container and said application component is mounted to said mounting hoop.

9. A device according to claim 8, wherein the mounting hoop is mounted to the container by one of a snap-fastening and a screw coupling.

10. A device according to claim 1, wherein the applicator portion includes an annular surface having a constant width.

11. A device according to claim 1, wherein the applicator portion includes an annular surface having a variable width.

12. A device according to claim 1, wherein the applicator portion includes an annular surface which is continuous.

13. A device according to claim 1, wherein the applicator portion includes a discontinuous surface.

14. A device according to claim 1, wherein the application component includes at least two applicator portions.

15. A device according to claim 14, wherein at least two of said product holding components are provided, each suitable for containing a different product and releasing it to one of the applicator portions.

16. A device according claim 1, wherein said product holding component includes a material selected from the group consisting of foams, frits, and textile fibers.

17. A device according to claim 1, wherein said product holding component includes a cellular material.

18. A device according to claim 1, wherein all of the product is contained in said product holding component.

19. A device according to claim 1, further including a bottle having an opening, wherein said bottle is accommodated in the container and contains the product, and wherein said product holding component is disposed adjacent the opening of the bottle.

20. A device according to claim 19, wherein said bottle includes a neck, and wherein said product holding component is accommodated inside the neck of the bottle.

21. A device according to claim 19, wherein said bottle includes a neck, and wherein said product holding component is at least partially disposed above the neck of the bottle.

22. A device according to claim 1, further including a closure cap which covers the application component.

23. A device for packaging and applying a product, comprising:

a container suitable for containing the product;

an application component including at least one applicator portion suitable for coming in contact with the product in order to take up some of the product;

a rotational coupling arranged on at least one side of the applicator portion including a lug disposed inside a cavity and allowing the application component to be moved in rotation about an axis Y relative to the container, wherein the lug is in contact with an edge at least partially delimiting the cavity;

the application component including at least one portion separating the applicator portion from the rotational coupling, said at least one portion having a non-constant cross section along the axis Y measured transversely to the axis Y, and wherein a diameter of the at least one portion continuously decreases from the applicator portion to one of the lug and the cavity, and the at least one portion includes a section, which is a section of the at least one portion with a smallest diameter immediately adjacent to the one of the lug and cavity, and said section extends from said rotational coupling by defining an acute angle with a line parallel to the axis of rotation, as measured inside the at least one portion, where the section and the one of the lug and cavity meet.

24. A device according to claim 23, wherein said contact between said lug and said edge is along an essentially continuous line.

25. A device according to claim 23, wherein said contact between said lug and said edge is along a discontinuous line.

26. A device according to claim 23, wherein said lug is associated with said container and said cavity is associated with said application component.

27. A device according to claim 23, wherein said cavity is associated with said container and said lug is associated with said application component.

28. A device according to claim 23, further including a product holding component which holds the product, and wherein the application component contacts said product holding component to take up some of the product from the product holding component.

29. A device according to claim 23, wherein said product is a make up product.

30. A device according to claim 23, wherein said product is an eye make up product.

31. A device for packaging and applying a make up product comprising:

a container having the make up product therein;

a rotatable application component having at least one applicator portion which comes into contact with the product to take up the product, said rotatable application component having a width in a direction of an axis of rotation Y of said rotatable application component which is substantially larger than a width of said applicator portion such that said applicator portion is spaced from a location at which said rotatable application component is mounted to said container, wherein a portion of the rotatable application component includes a section which is a section of the at least one portion with a smallest diameter, immediately adjacent to one of a lug and cavity through which said rotatable application component is mounted to the container and the section extends from the location at which said rotatable application component is mounted to the container by defining an acute angle with a line parallel to the axis of rotation as measured inside the at least one portion, where the section and the one of the lug and cavity meet, and a diameter of the at least one portion continuously decreases in a direction from the applicator portion to the one of the lug and cavity.

32. A device as recited in claim 31, wherein said product in said container is an eye make up product.

33. A device as recited in claim 31, wherein said lug contacts an edge of said cavity about a periphery of said cavity.

34. A device as recited in claim 33, wherein said edge forms a continuous contact edge about the periphery of said cavity.

35. A device as recited in claim 33, wherein said edge forms a discontinuous contact edge about the periphery of said cavity.

36. A device as recited in claim 31, further including a product holding component comprising at least one of a cellular material and a fibrous material, and wherein said applicator portion contacts said product holding portion to take up product on said applicator portion.

37. A device as recited in claim 31, further including a mounting hoop mounted to said container, and wherein said rotatable application component is rotatably mounted to said mounting hoop.

38. A device as recited in claim 37, wherein said mounting hoop includes an opening and said rotatable application component is mounted in said opening and closes a majority of said opening.

39. A device as recited in claim 5, wherein the lug is integrally formed with the application component.

40. A device as recited in claim 1, wherein one the lug is hemispherical in shape.

41. A device as recited in claim 1, wherein the cavity is a through-hole disposed in a first tab located on a mounting hoop, which is snap-fit to the container.

42. A device as recited in claim 41, wherein said rotational coupling includes a second through-hole disposed in a second tab located on said mounting hoop, which is snap-fit to the container.

43. A device as recited in claim 1, wherein the applicator portion includes a surface parallel to the axis of rotation Y, and a gap is disposed on each side of the surface at a point at which the surface comes into direct contact with the porous material.

* * * * *